US005125370A

United States Patent [19]

Kawamura

[11] Patent Number: 5,125,370

[45] Date of Patent: Jun. 30, 1992

[54] CONTROL SYSTEM FOR ELECTROMAGNETICALLY DRIVEN VALVE

[75] Inventor: Hideo Kawamura, Samukawa, Japan

[73] Assignee: Isuzu Ceramics Research Institute Co., Ltd., Fujisawa, Japan

[21] Appl. No.: 499,338

[22] PCT Filed: Oct. 20, 1989

[86] PCT No.: PCT/JP89/01080

§ 371 Date: Jun. 18, 1990

§ 102(e) Date: Jun. 18, 1990

[30] Foreign Application Priority Data

Oct. 20, 1988 [JP] Japan ..... 63-264831

[51] Int. Cl.[5] ..... F01L 9/04

[52] U.S. Cl. ..... 123/90.11; 251/129.01

[58] Field of Search ..... 123/90.11, 90.15; 251/129.01, 129.05, 129.09

[56] References Cited

U.S. PATENT DOCUMENTS

| | | | |
|---|---|---|---|
| 4,205,634 | 6/1980 | Tourtelot, Jr. | 123/90.16 |
| 4,651,684 | 3/1987 | Masuda et al. | 123/90.16 |
| 4,706,619 | 11/1987 | Buchl | 123/90.11 |
| 4,715,332 | 12/1987 | Kreuter | 123/90.11 |
| 4,823,825 | 4/1989 | Buchl | 123/90.11 |
| 4,829,947 | 5/1989 | Lequesne | 123/90.11 |
| 4,942,851 | 7/1990 | Kawamura | 123/90.11 |
| 4,972,810 | 11/1990 | Kawamura | 123/90.11 |
| 5,050,543 | 9/1991 | Kawamura | 123/90.11 |

FOREIGN PATENT DOCUMENTS

| | | | |
|---|---|---|---|
| 2616481 | 12/1988 | France | 123/90.11 |
| 183805 | 10/1983 | Japan | 123/90.11 |
| 195004 | 11/1983 | Japan | 123/90.11 |
| 162312 | 9/1984 | Japan | 123/90.11 |
| 6012 | 1/1985 | Japan | 123/90.11 |

*Primary Examiner*—E. Rollins Cross
*Assistant Examiner*—Weilun Lo
*Attorney, Agent, or Firm*—Staas & Halsey

[57] ABSTRACT

A control system electromagnetically controls the operation of a valve which opens and closes an intake/exhaust port through which the interior and exterior of an engine cylinder communicate with each other. Since the timing with which the intake and exhaust valves are opened and closed cannot be altered during operation of the engine, the valve opening and closing timings are preset such that the engine operates with high efficiency when it rotates at a predetermined speed. When the engine is operating at a speed lower than the above predetermined speed, a air-fuel mixture which has once been drawn into the cylinder is discharged back out of the cylinder or discharged through the cylinder, resulting in a reduction in the efficiency and output power of the engine. The intake and exhaust valves are electromagnetically opened and closed, and the valve opening and closing timings are varied depending on the rotational speed of the engine, so that the air-fuel mixture is prevented from being discharged back from or through the cylinder, for increased engine efficiency and output power.

11 Claims, 2 Drawing Sheets

CONTROL SYSTEM FOR ELECTROMAGNETICALLY DRIVEN VALVE

BACKGROUND OF THE INVENTION

1. Field of the Invention

The present invention relates to a control system for electromagnetically controlling the operation of a valve which opens and closes an intake/exhaust port through which the interior and exterior of an engine cylinder are connected.

2. Description of the Related Art

Conventional control systems for controlling the opening and closing intake and exhaust valves operate as follows. When fuel is burned in a combustion chamber, the piston is lowered to cause the connecting rod to rotate the crankshaft. A camshaft disposed in the cylinder head is driven by the crankshaft and a timing belt, and the intake and exhaust valves are opened and closed by rocker arms held against cam surfaces of the camshaft.

Since the timing with which the intake and exhaust valves are opened and closed cannot be altered during operation of the engine, the valve opening and closing timing is preset such that the engine operates with high efficiency when it rotates at a predetermined speed.

More specifically, the timing with which the intake valve is opened is selected as a crankshaft angle ranging from 20° to 30° before the top dead center (TDC) of the piston is reached, and the timing with which it is closed is selected as a crankshaft angle ranging from 50° to 60° after the bottom dead center (BDC) is passed.

The timing with which the exhaust valve is opened is selected as a crankshaft angle ranging from 50° to 60° before the bottom dead center (BDC), and the timing with which it is closed is selected as a crankshaft angle ranging from 20° to 30° after the top dead center (TDC).

With the conventional settings for the timing with which the intake and exhaust valves are opened and closed, the intake valve remains open even after the bottom dead center (BDC) is passed. As a result, when the engine is operating at a speed lower than the above predetermined speed, an air-fuel mixture which has already been drawn into the cylinder is discharged back out of the cylinder through the intake port as the piston moves upwardly, resulting in a reduction in the engine output power.

Similarly, after the top dead center (TDC) is passed, the exhaust valve still remains open for a certain period of time. As a result, an unburned air-fuel mixture that was introduced from the intake port does not stay in the cylinder, but is discharged from the cylinder through the exhaust port, resulting in poor fuel economy.

Valve control systems which use electromagnetic means rather than camshafts for driving intake and exhaust valves are disclosed in Japanese Laid-Open Patent Publications Nos. 58-183805 and 61-76713. However, the disclosed valve control systems are not designed to solve the above problems.

SUMMARY OF THE INVENTION

In view of the aforesaid problems, it is an object of the present invention to provide a control system for an electromagnetically driven valve, which prevents an air-fuel mixture from being discharged back from or through a cylinder even when the engine operates at low speed, so that the engine can produce an increased output power with increased fuel economy.

According to the present invention, there is provided a control system for controlling the opening and closing timings of an electromagnetically driven intake/exhaust valve of an internal combustion engine. The control system opens and closes the valve by energizing and deenergizing electromagnets located closely to a magnetic portion of the valve. A control unit detects the rotational speed of the engine and energizes and deenergizes the electromagnets at timings corresponding to the rotational speed. As a result, the valve is opened and closed at the most efficient times.

The intake/exhaust valve is electromagnetically opened and closed by the control system according to the present invention. In operation, the rotational speed of the engine is detected. When the rotational speed of the engine is low, the intake/exhaust valve is opened and closed at timings near the top dead center (TDC) and the bottom dead center (BDC). As the engine rotational speed increases, the intake/exhaust valve is opened and closes at timings farther from the top dead center (TDC) and the bottom dead center (BDC).

In a full range of engine rotational speeds, therefore, the air-fuel mixture is prevented from being discharged back from or through the cylinder, and the engine output power and efficiency are increased.

DESCRIPTION OF THE PREFERRED EMBODIMENTS

An embodiment of the present invention will hereinafter be described with reference to the drawings.

Figure 1:
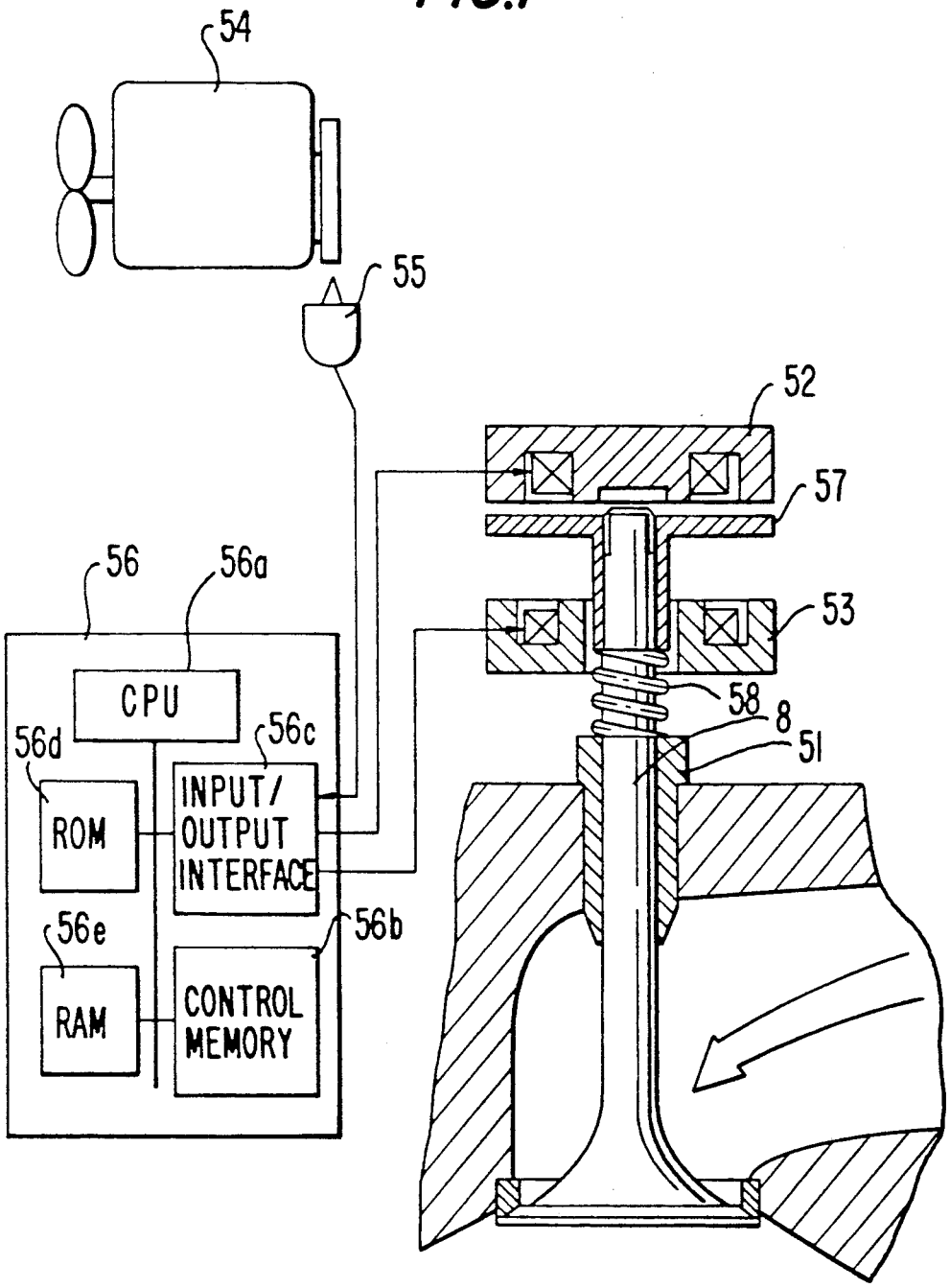
FIG. 1 is a block diagram showing a control system for an electromagnetically driven valve partially shown in section according to an embodiment of the present invention.

FIG. 1 is a block diagram showing a control system for an electromagnetically driven valve according to an embodiment of the present invention.

An intake valve 8 is made of a light heat-resistant material such as ceramic or a heat-resistant alloy. A magnetic member 57 is mounted on the end of the stem of the intake valve 8. The intake valve 8 is held by a valve guide 51 which guides the intake valve 8 for axial movement. A spring 58 is disposed around the stem between the valve guide 51 and the magnetic member 57 for urging the intake valve 8 to move upwardly.

An upper circular electromagnet 52 is disposed a predetermined distance up from the magnetic member 57, and a lower circular electromagnet 53 is disposed a predetermined distance down from the magnetic member 57. The upper and lower electromagnets 52, 53 have respective coils connected to an input/output interface **56*c* in a control unit 56**.

To the input/output interface **56*c*, there is also connected a rotation sensor 55 for detecting the rotational speed of the engine 54 and the crankshaft angle thereof. The control unit 56 also includes a CPU 56*a* for carrying out arithmetic operations based on a program and a table representing the relationship between engine rotational speeds and valve opening/closing timings stored in a ROM 56d, a RAM 56e for temporarily storing data, and a control memory 56b for controlling the operation of the blocks of the control unit 56**.

Operation of the control system according to the present invention will be described below.

The rotational speed of the engine 1 detected by the rotation sensor 55 is sent through the input/output interface 56c and temporarily stored in the RAM 56e. Then, a valve opening/closing timing is determined from the engine rotational speed stored in the RAM 56e, using a table stored in the ROM 56d. The table indicates the relationship between engine rotational speeds and valve opening/closing timings designed to obtain maximum efficiency. This table is shown by way of example in FIG. 2.

Figure 2:
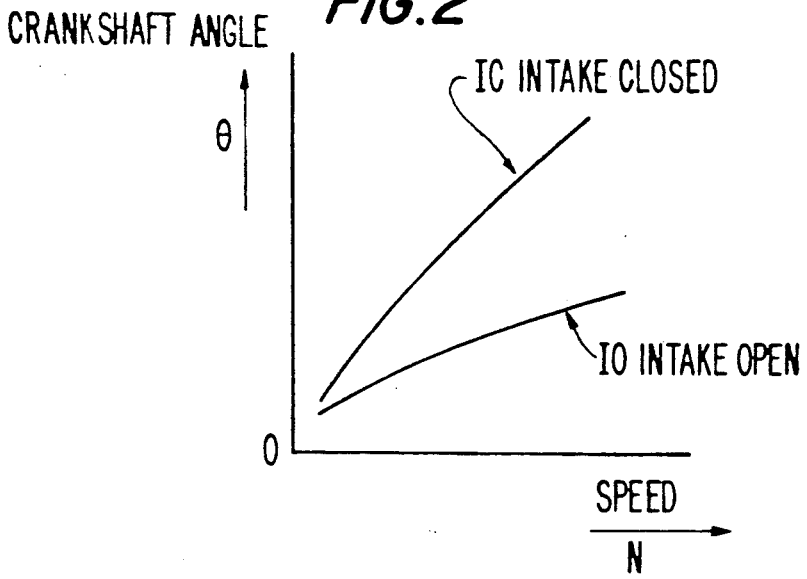
FIG. 2 is a diagram showing a table illustrating the relationship between engine rotational speeds and timings with which a valve is opened and closed.

In FIG. 2, the horizontal axis represents the engine rotational speed which increases to the right, and the vertical axis represents the crankshaft angle. The timing IC (closing timing), indicates a crankshaft angle after the bottom dead center (BDC) at which the intake valve is to be closed, and the timing IO, indicates a crankshaft angle before the top dead center (TDC) at which the intake valve is to be opened.

As shown in FIG. 2, when the engine rotational speed decreases, the closing timing (IC) approaches the bottom dead center (BDC), and the opening timing (IO) approaches the top dead center (TDC).

While the table shown in FIG. 2 shows the engine rotational speeds and the opening/closing timings, a correction for causing the opening/closing timings to approach the top and bottom dead centers as the engine load is reduced may be used in or added to the table.

When the opening/closing timings for the intake valve 8 have been determined from the table, drive signals are transmitted to the upper and lower electromagnets 52, 53 based on the crankshaft angle as detected by the rotation sensor 55.

Figure 3:
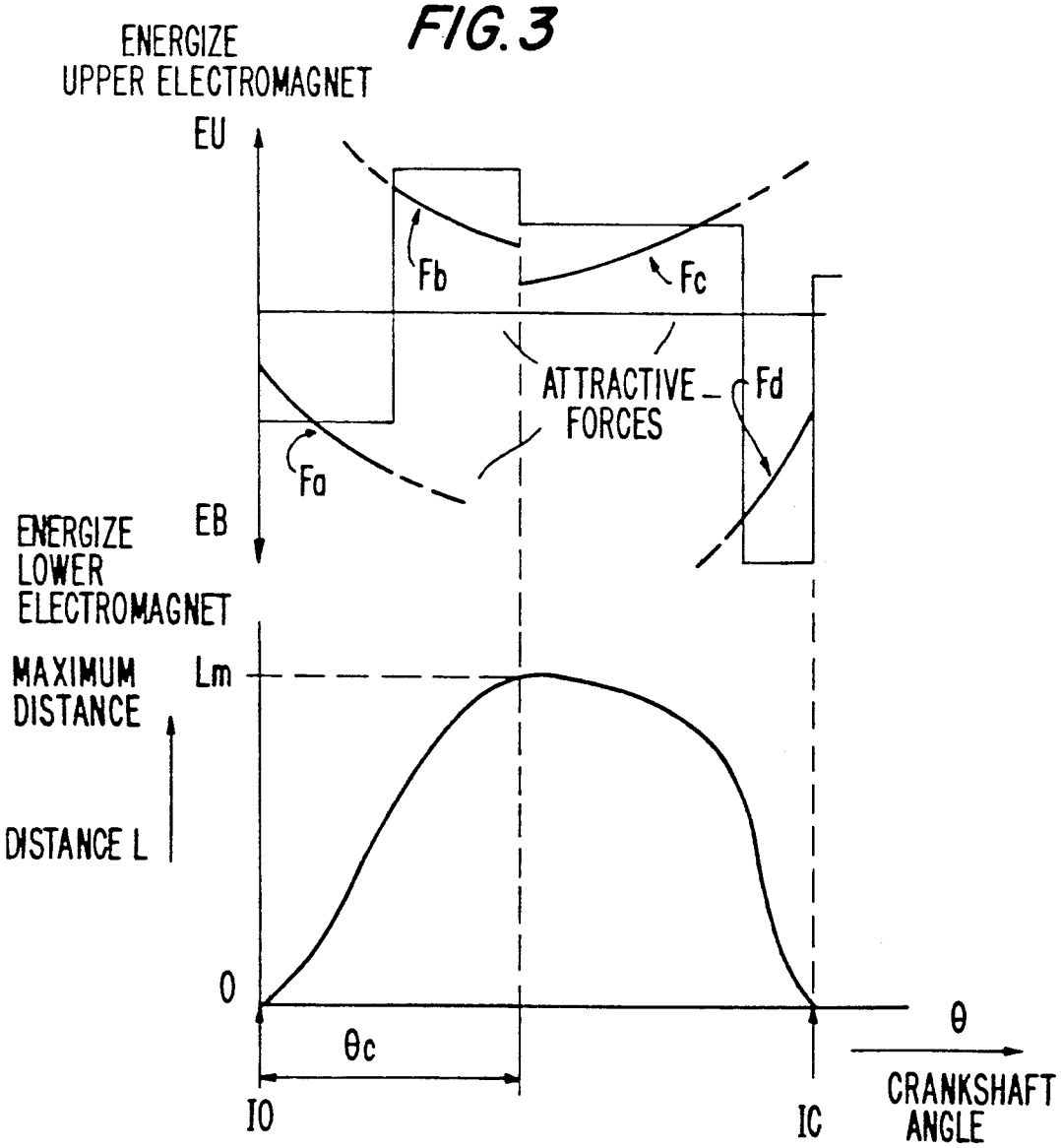
FIG. 3 is a diagram showing the relationship between crankshaft angles and distances which the valve moves.

The relationship between crankshaft angles and distance which the valve moves is shown in FIG. 3.

The lower curve represents a cam profile curve of the camshaft. The vertical axis represents the distance L which the valve moves, corresponding to the lift of the cam profile. The horizontal axis represents crankshaft angle. The lower curve is indicated between the opening timing (IO) and the closing timing (IC) of the intake valve 8.

The upper portion of FIG. 3 shows a condition EU in which the upper electromagnet 52 is energized, a condition EB in which the lower electromagnet 53 is energized, and attractive forces Fa, Fb, Fc, Fd produced by these electromagnets. Since the electromagnetic attractive forces are inversely proportional to the square of the distance between the electromagnets and the magnetic member, the curves Fa, Fb, Fc, Fd are quadratic curves.

When the intake valve 8 is closed, the coil of the upper electromagnet 52 is continuously energized to keep the intake valve 8 closed, so that the intake valve 8 remains attracted upwardly through the magnetic member 57. When the crankshaft angle reaches IO, the upper electromagnet 52 is de-energized to cancel the upward attractive force, and the lower electromagnet 53 is energized to generate a downward attractive force Fa to open the intake valve 8. The intake valve 8 is attracted downwardly, opening the intake port.

When the crankshaft angle reaches a predetermined first angle from IO, the lower electromagnet 53 is deenergized, and the upper electromagnet 52 starts being energized. The upper electromagnet 52 generates the upward attractive force Fb in the valve closing direction. The speed at which the intake valve 8 moves is now reduced. At the time an angle $\theta c$ has elapsed from IO, the intake valve 8 is stopped by force $F_b$ at a maximum distance Lm which it has traversed.

Upon elapse of $\theta c$, the current passing through the upper electromagnet 52 is varied to change the upward attractive force from Fb to Fc. When the crankshaft angle reaches a predetermined second angle, which is greater than $\theta c$, from IO, the upper electromagnet 52 is deenergized, and the lower electromagnet 53 is energized. As a result, the speed at which the intake valve 8 moves upwardly is reduced by the downward attractive force Fd. Therefore, the shock with which the intake valve 8 is seated is lessened.

The spring 58 is provided in order to prevent the intake valve 8 from being lowered downwardly when the control system is not in operation at the time the motor vehicle is at rest, for example. The spring 58 normally urges the intake valve 8 upwardly, and the urging force of the spring 58 is selected such that it will not significantly affect the attractive forces Fa, Fd of the lower electromagnet 53.

The process beginning with opening timing IO until the maximum distance $L_m$ is traversed by the valve will be described below using equations.

If it is assumed that then engine rotational speed is indicated by N (RPM), the crankshaft angle by $\theta$ (deg), and the time by t (sec), then the following relationship is satisfied:

$$\theta = 6Nt.$$

If it is assumed that the acceleration applied to the intake valve is indicated by $\alpha$, the distance traversed by the intake valve by L, the attractive force by F, and the valve mass by m, then the distance L and the attractive force F are expressed as follows:

$$L = \tfrac{1}{2}\alpha t^2$$

$$F = m\alpha.$$

Therefore, during a period of time in which the downward acceleration $\alpha_1$ is imposed by the lower electromagnet 53, the attractive force Fa is given by:

$$Fa = m\alpha_1,$$

hence, $$\alpha_1 = Fa/m.$$

When the intake valve is accelerated up to $\theta n$ with the acceleration $\alpha_1$, the speed Va of the valve and the distance La traversed by the valve can be expressed, using the accumulation of small times $\Delta t$, as follows:

$$\text{Speed } Va = \sum_n (Fan/m)(\Delta\theta/6N)$$

$$\text{Distance } La = \tfrac{1}{2} \sum_n (Fan/m)\,(\Delta\theta/6n)^2$$

Since the crankshaft angle is $\theta c$ from the valve closing condition until the maximum distance $L_n$ traversed by the valve, the valve has to be decelerate and its speed has to be reduced to 0 during the interval of $\theta c$–$\theta n$.

Therefore, the lower electromagnet 53 is de-energized and at the same time the upper electromagnet 52 is energized to give an upward acceleration $\alpha b$ to the intake valve, thus decelerating the intake valve. The upward attractive force Fb produced by the upper electromagnetic 52 is given by:

$$Fb = m\alpha b.$$

and therefore, the speed V of the intake valve while it is decelerating is expressed by:

$$V = Va - \sum_q (Fbqm)(\Delta\theta/6N)$$

The attractive force Fb is determined so that the speed becomes V=0 at the position in which the crankshaft angle is $\theta c$.

The maximum distance Lm traversed by the valve is expressed as follows:

$$Lm = La + \frac{1}{2}\sum_q (Fbq\ m)(\Delta\theta/6N)^2$$

For closing the valve, the same arithmetic operations as those described above may be carried out.

While the present invention has been described with respect to the intake valve, the present invention is also applicable to an exhaust valve except that the timings with which it is closed and opened are different.

Although a certain preferred embodiment has been shown and described, it should be understood that many changes and modifications may be made therein without departing from the scope of the appended claims.

The control system according to the present invention controls the opening and closing of an intake/exhaust valve of an engine when the valve is electromagnetically opened and closed. The rotational speed of the engine is detected, and the opening and closing timings of the intake/exhaust valve are varied as the rotational speed increases or decreases, so that the efficiency and output power of the engine are made greater than those of conventional engines in a full range of engine rotational speeds.

I claim:

1. A control system for controlling the opening and closing timings of an electromagnetically driven valve that is one of an intake valve and exhaust valve in an internal combustion engine having a crankshaft rotated by oscillation of a piston between a top dead center position and a bottom dead center position, comprising:

a magnetic plate coupled to the valve;

electromagnets having fixed magnetic poles confronting end faces of said magnetic plate in directions in which the magnetic plate is reciprocally movable, said electromagnets including an upper and lower electromagnet;

a rotation sensor for detecting the rotational speed of the internal combustion engine;

valve opening/closing means for energizing said electromagnets to produce attractive forces acting between said magnetic plate and the fixed magnetic poles, the attractive forces opening and closing the intake/exhaust valve; and timing varying means for varying the timings with which the intake/exhaust valve is opened and closed by said valve opening/closing means to open or close the valve more closely to the top dead center position and the bottom dead center position of the piston when the rotational speed as detected by said rotation sensor is reduced said timing varying means controlling said valve opening/closing means to energize said upper electromagnet to hold the valve closed until the crankshaft reaches a first angle, to energize said lower electromagnet to open the valve when the crankshaft reaches the first angle, to energize said upper electromagnet at a first current to slow opening of the valve when the crankshaft reaches a second angle beyond the first angle, to energize said upper electromagnet at a second current to close the valve when the valve has been completely opened, and to energize said lower electromagnetic to slow closing of the valve when the crankshaft reaches a third angle beyond the second angle.

2. A control system according to claim 1, wherein said valve is made of ceramic.

3. A control system according to claim 1, wherein said valve opening/closing means attracts said magnetic plate in an opening direction of the valve immediately before said valve is seated, so that a shock caused when the valve is seated will be lessened.

4. A control system according to claim 1, further comprising a load sensor for detecting a load on said internal combustion engine, and said timing varying means varying the timings with which the valve is opened and closed by said valve opening/closing means more closely to the top dead center position and the bottom dead center position of the piston when the load on the engine as detected by said load sensor is reduced.

5. A control system according to claim 1, wherein said fixed magnetic poles comprise a pair of fixed magnetic poles having different polarities.

6. A valve control system in an engine with a crankshaft, comprising:

upper and lower electromagnets having coils;

a valve having a magnetic portion positioned closely to said electromagnets;

control means for controlling movement of said valve by energizing and deenergizing the coils of said electromagnets at timings corresponding to a position of the crankshaft and a speed of the engine said control means controlling movement of said valve by energizing said upper electromagnet to hold the valve closed until the crankshaft reaches a first angle, by energizing said lower electromagnet to open the valve when the crankshaft reaches the first angle, by energizing said upper electromagnet at a first current to slow opening of the valve when the crankshaft reaches a second angle beyond the first angle, by energizing said upper electromagnet at a second current to close the valve when the valve has been completely opened, and by energizing said lower electromagnet to slow closing of the valve when the crankshaft reaches a third angle beyond the second angle.

7. A valve control system according to claim 6, further comprising speed detection means for detecting the speed of the engines, and said control means comprising a control unit including an input/output interface connected to said electromagnets and said speed detection means, a storage storing a table of the timing corresponding to different speeds of the engine, and a processor calculating the timings based on the speed detected by said detection means.

8. A valve control system according to claim 7, wherein said electromagnets comprise an upper electromagnet and a lower electromagnet, each separately connected to the input/output interface and separately controlled by the control unit, and the magnetic portion of said valve being positioned between the upper electromagnet and lower electromagnet and upwardly and downwardly movable corresponding to an energizing and deenergizing of the upper electromagnet and lower electromagnet.

9. A method of controlling a valve in an engine, the valve having a magnetic portion positioned closely to electromagnets, said method comprising the steps of:

a) detecting a speed of the engine;

b) reading the speed of the engine into a computer;

c) energizing and deenergizing the electromagnets at timings corresponding to the speed of the engine, with the computer wherein the electromagnets include an upper electromagnet and a lower electromagnet, and wherein step (c) further comprises the steps of (C1) holding the valve closed by energizing the upper electromagnet until a first timing, (C2) opening the valve by deenergizing the upper electromagnet and energizing the lower electromagnet until a second timing, (C3) closing the valve by energizing the upper electromagnet and deenergizing the lower electromagnet until a third timing, and (C4) decelerating the valve before it is closed by deenergizing the upper electromagnet and energizing the lower electromagnet until a fourth timing.

10. A method according to claim 9, wherein said energizing and deenergizing of the electromagnets in step (c) is performed at the timings read by the computer from a preset speed/timing table based on the speed.

11. A method according to claim 9, wherein the engine includes a piston which rotates a crank shaft, and wherein step (C1)-(C4) are repeated with each full piston stroke of the engine, and the first, second, third and fourth timing correspond to angles of rotation of the crank shaft.

* * * * *